United States Patent [19]

Stratton

[11] Patent Number: 4,662,179

[45] Date of Patent: May 5, 1987

[54] FUEL INJECTOR

[75] Inventor: John F. Stratton, Blackburn, England

[73] Assignee: Lucas Industries public limited company, Birmingham, England

[21] Appl. No.: 910,782

[22] Filed: Sep. 23, 1986

Related U.S. Application Data

[63] Continuation of Ser. No. 744,695, Jun. 14, 1985, abandoned.

[30] Foreign Application Priority Data

Jun. 14, 1984 [GB] United Kingdom ..... 8415218

[51] Int. Cl.[4] ..... F02C 1/00; F23D 11/40

[52] U.S. Cl. ..... 60/737; 239/419.3

[58] Field of Search ..... 60/734, 737, 740, 742, 60/748; 239/419.3, 422, 424.5, 425

[56] References Cited

U.S. PATENT DOCUMENTS

| | | | |
|---|---|---|---|
| 3,652,016 | 3/1972 | Cheshire | 239/424.5 |
| 3,764,071 | 10/1973 | Carlisle | 60/748 |
| 3,808,803 | 5/1974 | Salvi | 60/737 |
| 3,912,164 | 10/1975 | Lefebvre et al. | 60/748 |
| 4,170,108 | 10/1979 | Mosby | 60/740 |
| 4,327,547 | 5/1982 | Hughes | 60/742 |
| 4,342,198 | 8/1982 | Willis | 60/737 |
| 4,470,262 | 9/1984 | Shekleton | 60/737 |

*Primary Examiner*—Louis J. Casaregola
*Assistant Examiner*—Timothy S. Thorpe

[57] ABSTRACT

A fuel injector for a gas turbine engine comprises a hollow body having an upstream air inlet and downstream primary and secondary air outlet passages. The primary air outlets are disposed to direct primary air substantially parallel to the axis of the hollow body. The secondary air outlet passages are disposed radially inwardly of the respective primary air outlets and arranged to discharge secondary air outwardly so as to subject the primary air to shear. Fuel passages are disposed so as to discharge fuel through the primary air outlets in the same direction as the primary air. The shearing action promotes efficient atomization of fuel in the required distribution pattern without using a swirling action.

7 Claims, 2 Drawing Figures

FUEL INJECTOR

Figure 1:
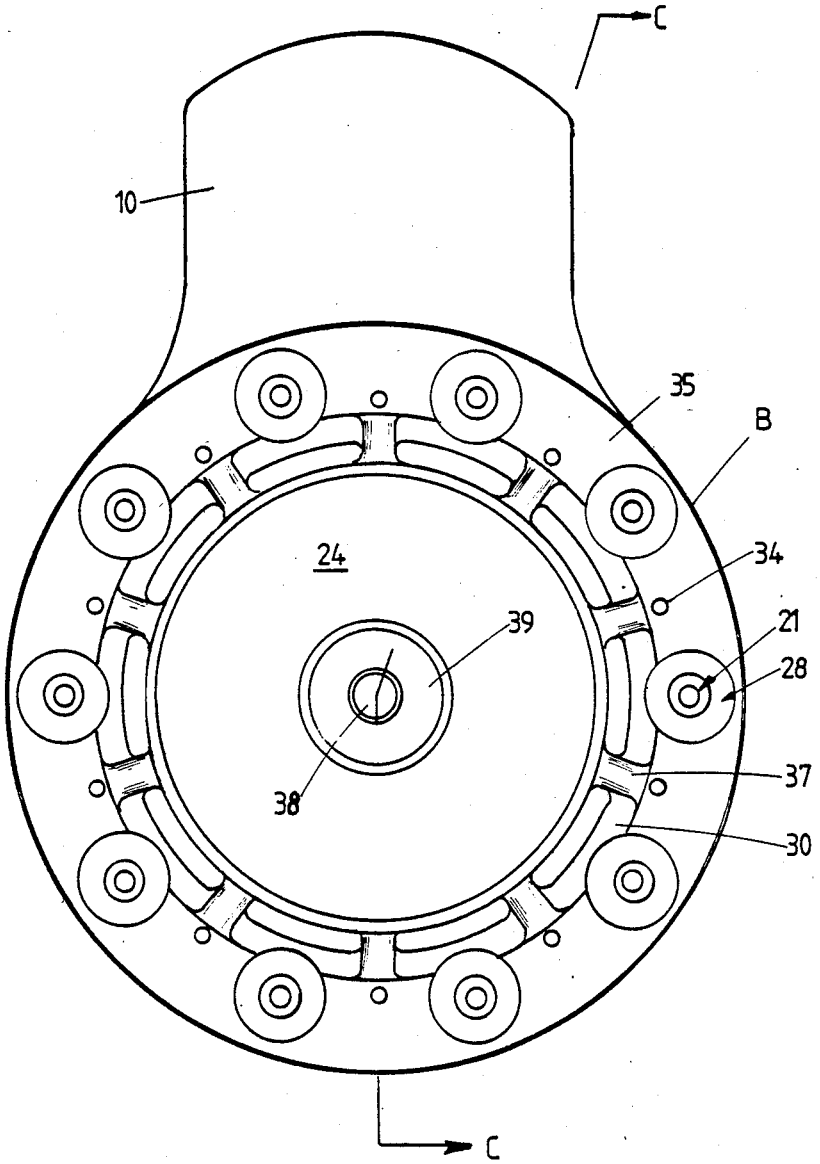

This application is a continuation, of application Ser. No. 744,695, filed June 14, 1985, now abandoned.

This invention relates to a fuel injector and is particularly concerned with a fuel injector for supplying a fuel/air mixture for burning in a combustion chamber. The invention is particularly but not exclusively, applicable to fuel injectors for gas turbine engines.

It is an object of the present invention to provide a fuel injector which can be used to provide efficient atomisation of fuel in the required distribution pattern without the use of swirl components. The avoidance of a swirling outflow can be advantageous in preventing undesirable interactions with the gas flow pattern within the combustion chamber.

According to the present invention, there is provided a fuel injector comprising (1) a hollow body which has an air inlet at an upstream axial end thereof and primary and secondary air outlets at a downstream axial end thereof, the primary air outlets being spaced apart angularly about the axis of the hollow body and being disposed so as to discharge air from the downstream end of the body in a direction substantially parallel to the axis of the body, and the secondary air outlet passages being disposed radially inwardly of the respective primary air outlets and arranged to discharge air from the downstream end of the body outwardly relative to the axis of the body so that, in use, the jets of air issuing from the primary air outlets are subjected to shear in the radial direction by the jets of air issuing from the respective secondary air outlet passages; (2) a plurality of fuel passages in the body, each passage having a fuel outlet associated with a respective one of the primary air outlets and disposed so as to discharge fuel in the same direction as the air discharged from the associated primary air outlet, and (3) means for supplying fuel to said fuel passages.

In a preferred embodiment, the main air passage is provided with a frusto-conical baffle at its downstream end, the baffle being supported by the webs and being arranged so that it diverges in the downstream direction so that the outer periphery of the baffle defines downstream sides of the secondary air outlets.

Preferably, the frusto conical baffle is supported by a series of spaced webs, said webs defining secondary outlets disposed radially inwards of the primary outlets.

In order to prevent downstream edges of the webs being wetted with fuel and consequential formation of carbon thereon, it is preferred to provide air ducts which communicate with the main air passage and which are disposed so as to direct air flow over the downstream edges of the webs.

The baffle may be provided with a central passage therethrough which opens onto a downstream side of the baffle through an outwardly divergent flare which is positioned relative to the baffle so that an annular recess is defined therebetween, the recess surrounding the central passage through the baffle.

The baffle may be provided with a ring of further air passages therethrough, said further air passages opening into the annular recess between the flare and the baffle. With such a construction, scavenging of the downstream face of the baffle is effected by air so as to inhibit the deposition of fuel thereon in use.

As a further measure to inhibit deposition of fuel on the injector body, it is preferred for each fuel outlet to be disposed in the primary air stream in a position which is upstream of the respective primary air outlet.

Figure 2:
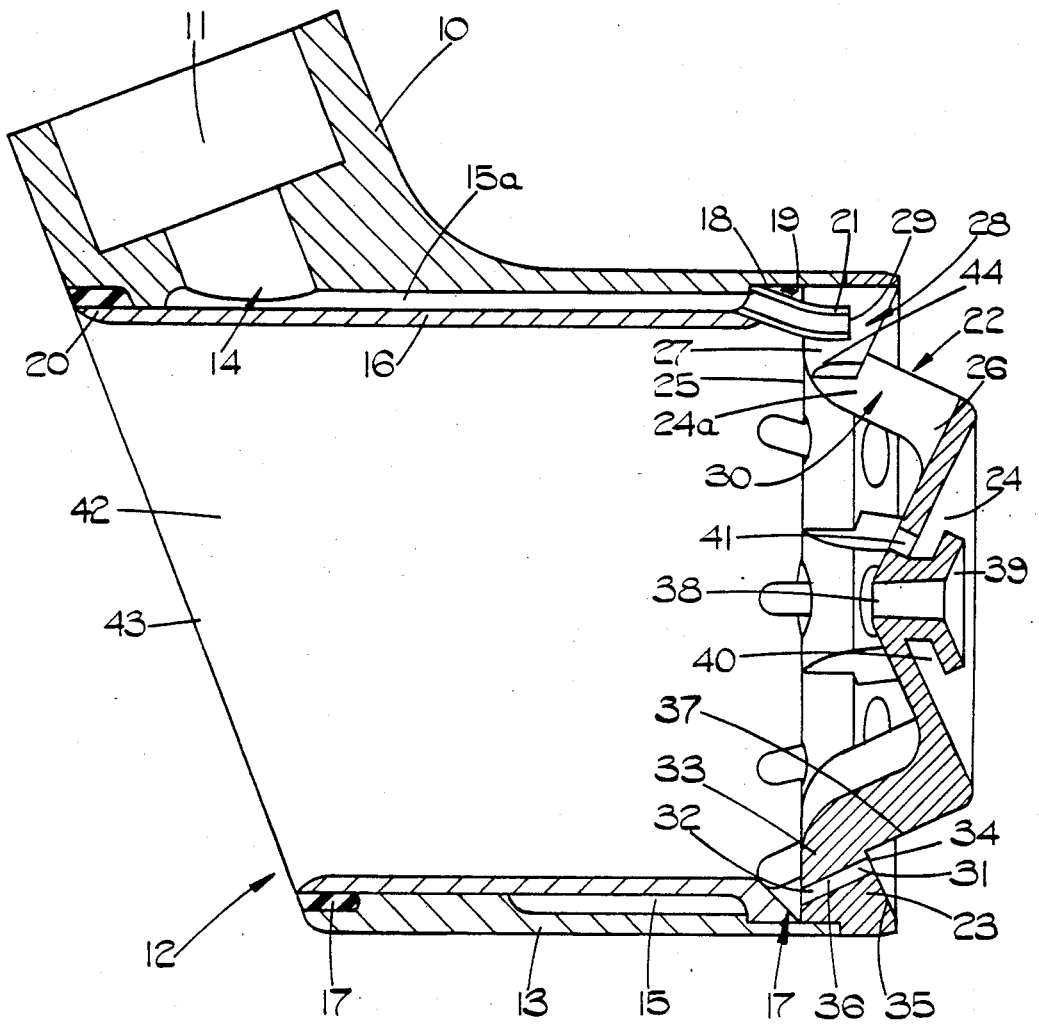

An embodiment of the present invention will now be described, by way of example, with reference to the accompanying drawings, in which:

FIG. 1 is a front elevation of a fuel injector according to one aspect of the present invention, and FIG. 2 is a longitudinal section on the line C—C of FIG. 1.

Referring now to the drawings, the fuel injector illustrated therein is for mounting in the combustion chamber (not shown) of a gas turbine engine by means of a support arm 10 (only partly shown) having an axial fuel supply passage 11 therein. The fuel injector comprises a composite hollow body indicated generally by reference numeral 12. The body 12 includes an outer, open ended sleeve 13 which is integrally formed with the support arm 10 and which has an opening 14 therethrough in alignment with the fuel supply passage 11. The sleeve 13 has an annular recess 15 in its inner periphery. A channel 15*a* provides communication between the passage 11 and the recess 15 via the opening 14. The body 12 further comprises an annular member 16 which is brazed at locations 17 within the outer sleeve 13, the brazing being effected by means of turns of brazing wire. The annular member 16 further includes a plurality of bores 18 (in this embodiment ten such bores are provided) which extend generally axially of the member 16 but which have a slight inclination in the radial direction. Each bore 18 opens into the annular recess 15 and into a downstream end portion 19 of the member 16. The downstream end portion 19 is frusto-conically flared in the downstream direction. The inner edge of an upstream end 20 of the member 16 is radiussed. Disposed in each of the bores 18 is a respective hypodermic tube 21 which extends from the annular recess 15 to project, in this embodiment, by more than half its length from the downstream end portion 19 of the member 16. Each tube 21 is brazed in the respective bore 18 and is curved so that a downstream end region thereof extends parallel to the axis of the body 12.

The body 12 further comprises a configurated front plate 22 located at the downstream end of the outer sleeve 13. The plate 22 has an annular outer section 23 and an inner frusto-conical baffle 24, said baffle 24 being located radially inwardly and axially downstream of the outer section 23 and connected to the same by webs 24*a* extending from the inner face 25 of the outer section 23 to the upstream face 26 of the baffle 24. The outer section 23, the baffle 24 and the webs 24*a* are of one-piece construction.

The outer section 23 also includes a series of equiangularly spaced primary air passages 27 which extend substantially parallel to the axis of the outer sleeve 13 and which define primary air outlets 28 of circular cross section. The primary air outlets are disposed so as to be coaxial with the downstream end regions of respective tubes 21. The air passages 27 are of a length such that the tubes 21 terminate upstream of the respective primary air outlets 28. The downstream ends of the tubes 21 define fuel outlets 29 which, as will be appreciated from the above descriptions, are disposed within the respective air passages 27. The connecting webs 24*a* are also arranged equiangularly around the baffle 24 such that they are equidistantly spaced between respective adjacent air passages 27 and so define secondary air outlet passages opening 30 radially inward of the respective primary air outlets 28.

The baffle 24 is coaxial with the outer section 23 and the outer sleeve 13 and disposed so as to be outwardly flared in the downstream direction.

A series of bores 31 is provided in the outer section 23, each bore 31 having an upstream end 32 in the upstream face 33 of the outer section 23 and a downstream end 34 in the downstream face 35 of the outer section 23, said bores 31 defining a series of air supply passages 36 which direct air flow along downstream edges 37 of the respective webs 24*a* in order to keep them free from fuel and thereby prevent carbon formation thereon.

The baffle 24 has a central air passage 38 therethrough which opens into a downstream surface of a flare 39 which is integrally formed with the baffle 24. As can be seen from FIG. 2, the flare 39 is also frustoconical and has its upstream surface spaced from the downstream surface of the baffle 24 so that an annular recess 40 is defined between the flare 39 and the baffle 24. The recess 40 surrounds the central air passage 38. A ring of small openings 41 through the baffle 24 open into this annular recess 40.

In use, air enters a main passage 42 in the body 12 via an air inlet opening 43 defined by the open upstream end of the annular member 16. Some of the air passing along the main passage 42 is diverted smoothly into each of the air passages 27 because of the angling of the downstream end portion 19 of the member 16 and of the radiussing (as at 44) of the upstream end of the passage 27. The air which enters the air passages 27 is discharged via the respective outlets 28 as primary air. Simultaneously, liquid fuel is supplied through fuel supply passage 11 to enter the annular recess 15 via opening 14 and channel 15*a*. From the annular recess 15, the fuel passes along the hypodermic tubes 21 to discharge through fuel outlets 29 whereat the fuel is mixed with the primary air and discharged through the primary air outlets 28 as spray plumes. In this embodiment, the spray plumes are divergent with an included angle of about 20°. These spray plumes are discharged in a direction substantially parallel to the longitudinal axis of the body 12.

At the same time, air in the passage 42 which has not entered the air passages 27 passes through the interior of the front plate assembly 22 and the majority of this air is discharged through the secondary air outlet passages 30, such discharge occurring relatively smoothly because of the shape of the openings 30. The jet of air discharged through each secondary air outlet passages 30 exerts a radially outward shearing action on the respective primary air/fuel mixture issuing from the associated primary air outlet 28 so as to provide a conically divergent spray pattern which is free from swirl because of the radially inward disposition of the openings 30 relative to the associated primary air outlets 28.

Some of the remaining air which has passed through the front plate assembly 22 passes through the baffle 24 via the ring of small openings 41 to enter the annular recess 40 and be diverted outwardly by the upstream face of the flare 39 so as to scavenge the downstream face of the flare 24. The remainder of the air passing through the inner portion of the front plate assembly leaves the body by way of the central opening 38 to scavenge the downstream face of the flare 39. The air which scavenges the downstream face of the baffle 24 enters the conical spray pattern whilst the air discharged through the opening 38 largely continues to travel along the longitudinal axis of the body 12.

In the above described fuel injector, a very high air throughput is possible for a small cross-sectional area. The inlet velocities are as high as 50% of the outlet velocities and parasitic air pressure losses within the injector are avoided because of the above described entry to the air passages 27 for primary air and because of the shape of the main air passage in the region of the openings 30. Additionally, deposit of liquid fuel on the downstream faces of the injector is inhibited because of the provision for scavenging of the spaces by air passing through the openings 41, passage 38 and the air supply passages 34. The provision of the passages 36, as noted above, prevent deposit of fuel on the downstream edges of the webs 24*a*.

The introduction of fuel into each air passage 27 further assists in preventing wetting of the downstream surfaces of the injector by fuel because the fuel becomes efficiently entrained in the surrounding primary air discharge, it being appreciated that each fuel tube 21 is completely surrounded by an annular flow of primary air through the respective air passage 27.

I claim:

1. A fuel injector for producing atomized fuel in a non-swirling distribution pattern comprising (1) a hollow body having an axis and an upstream axial end and a downstream axial end, (2) means defining an inlet at said upstream axial end of said hollow body; (3) means defining a plurality of primary air outlets at said downstream axial end of said hollow body, said primary air outlets being spaced apart angularly about said axis of said hollow body and extending essentially only axially of said body and directed downstream for discharging jets of primary air from said downstream axial end in a direction substantially only parallel to the axis of the body and having essentially no component of flow directed angularly with respect to the hollow body axis; (4) means defining a plurality of secondary air outlet passages at said downstream axial end of said hollow body, each of said secondary air outlet passages being located adjacent to a respective one of said primary air outlets and disposed radially inwardly of said respective one of said primary air outlets and having an upstream end located radially inward of a downstream end, each of said secondary outlet passages extending downstream from its upstream end to its downstream end to be inclined relative to said axis of said hollow body and directed downstream for discharging secondary air from the downstream end of the body radially outwardly and downstream relative to the axis of the body in the form of jets of secondary air, said jets of primary air issuing from each primary air outlet being directed axially and said jets of secondary air issuing radially outwardly from said secondary air outlet passages intersecting each other in the vicinity of said hollow body to subject the air issuing from said primary air outlets to shear in the radially outward direction; (5) means defining a plurality of fuel passages in said hollow body, each of said fuel passages having a fuel outlet end located within an associated one of said primary air outlets, each fuel outlet end being oriented transverely of and facing an axial downstream direction to discharge jets of fuel in the axial downstream direction; to discharge fuel into said associated primary air jet to mix with primary air issuing from said associated primary air outlet, said mixture of fuel and primary air being subjected to shear by said secondary air issuing from said secondary air outlet passages to produce a conically divergent spray pattern which is essentially free of swirl; and (6) means for supplying fuel to said fuel passages.

2. A fuel injector as claimed in claim 1, wherein hollow body is provided with a frusto-conical baffle at said downstream axial end, said baffle diverging in the downstream direction with the outer periphery of said baffle defining downstream sides of said secondary air outlet passages.

3. A fuel injector as claimed in claim 2, wherein said frusto-conical baffle is supported by a series of spaced webs, said webs defining side walls of said secondary air outlets.

4. A fuel injector as claimed in claim, 3, wherein means are provided which define air ducts communicating with the interior of said hollow body, said ducts being disposed radially outwardly of said webs so as to direct air flow over downstream edges of said webs.

5. A fuel injector as claimed in claim 2, wherein an outwardly divergent flare extends from a downstream side of said frusto-conical baffle so as to define an annular recess between said flare and said baffle, and a central passage passes through said baffle and said flare.

6. A fuel injector as claimed in claim 2, wherein said baffle is provided with further air passages therethrough which are defined on said baffle to form an annulus on said baffle, said further air passages opening into said annular recess between said flare and said baffle.

7. A fuel injector as claimed in claim 1, wherein each fuel outlet is disposed upstream of the respective primary air outlet.

* * * * *